US005265513A

United States Patent [19]

Smith

[11] Patent Number: 5,265,513

[45] Date of Patent: Nov. 30, 1993

[54] SOUND ENHANCING INSERT FOR STRINGED INSTRUMENTS

[76] Inventor: Theodore A. Smith, 9175 Butte Rd., Sweet, Id. 83670

[21] Appl. No.: 848,645

[22] Filed: Mar. 9, 1992

[51] Int. Cl.[5] ..... G10D 3/04

[52] U.S. Cl. ..... 84/298; 84/307

[58] Field of Search ..... 84/298, 299, 297 R, 84/307, 308, 309, 267, 268, 269, 270

[56] References Cited

U.S. PATENT DOCUMENTS

| | | | |
|---|---|---|---|
| 3,443,467 | 5/1969 | Richards | 84/298 |
| 3,896,695 | 7/1975 | Kingsbury | 84/307 |
| 4,197,779 | 4/1980 | Holman | 84/298 |
| 4,308,784 | 1/1982 | Eizonas | 84/452 |
| 4,335,641 | 6/1982 | Höpf | 84/297 R |
| 4,567,805 | 2/1986 | Clevinger | 84/1.16 |
| 4,584,923 | 4/1986 | Minnick | 84/454 |
| 5,092,213 | 3/1992 | Cipriani | 84/299 |

*Primary Examiner*—Michael L. Gellner

*Assistant Examiner*—P. Stanzione

*Attorney, Agent, or Firm*—Paul F. Horton

[57] ABSTRACT

A sound enhancing insert for stringed instruments in general and for guitars, in particular. The insert is readily mountable between the string supporting bridge saddle and the string tie-down members without repair, alteration of, or replacement of instrument parts. One or more rigid members, constructed of metal, wood, rigid plastic or ceramic, are mounted with a top surface of the rigid member contacting a respective string and the bottom surface of the rigid member contacting the sound table of the instrument. The rigid members are preferably mounted within a pliant soft plastic material such as Neoprene for supporting the rigid members in place and making the insert adaptable to different string heights. The rigid members, in their engagement between string and sound table, provide a second reverberation signal, a change in sustain, and a change in timbre, depending upon the particular material used.

19 Claims, 1 Drawing Sheet

FIG. 1
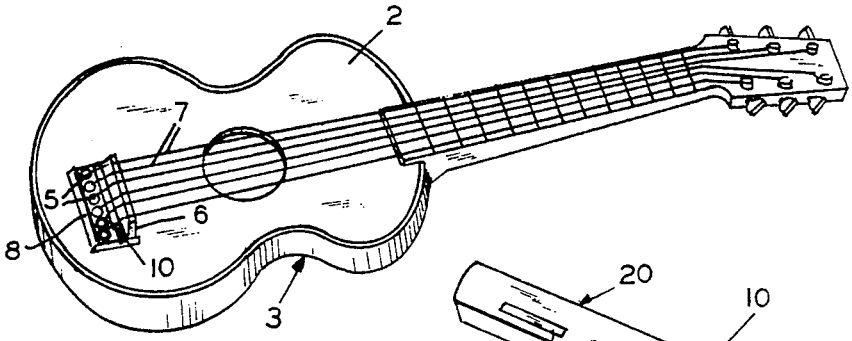
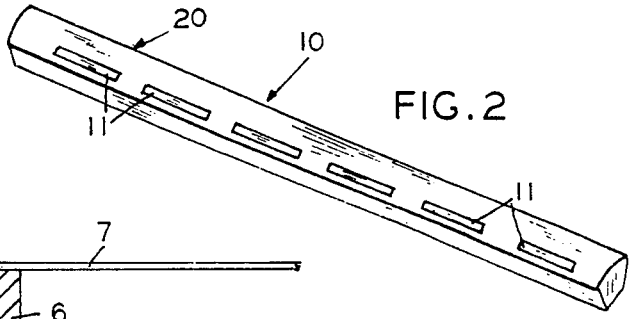
FIG. 2
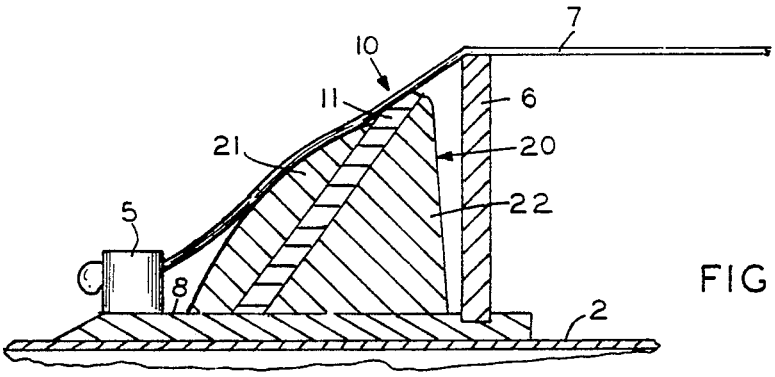
FIG. 3
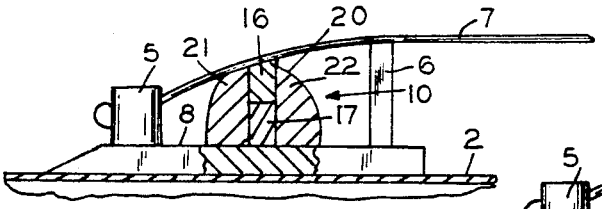
FIG. 5
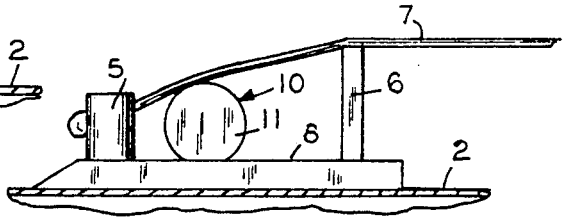
FIG. 4
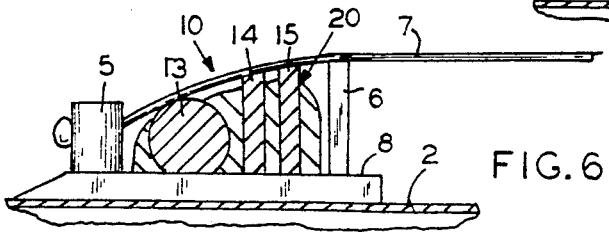
FIG. 6

SOUND ENHANCING INSERT FOR STRINGED INSTRUMENTS

BACKGROUND OF THE INVENTION

1. Field of the Invention

This invention relates, in general, to stringed instruments, and, more particularly, to guitars and sound enhancers therefore.

2. Description of the Prior Art

It has long been recognized that the sound of stringed instruments, and guitars and violins in particular, may be beneficially altered by the use of differing materials with which the strings of the instrument come in contact. To accomplish this effect, bridges have been improved; frets have been modified; and bridge pins have been substituted. Relevant patents include those of J. Doyle, U.S. Pat. No. 1,096,812 and W. E. Smith, U.S. Pat. No. 4,867,030; T. S. Eiazonas, U.S. Pat. No. 4,308,784; and M. R. Holman, U.S. Pat. No. 4,197,779, respectively. All of these inventions require replacement of an existing structural member with the improved or modified structure to effectuate the change in sound. Such changes often require permanent modification; often require a significant reconstruction of the instrument; and require time and patience to perfect the change.

SUMMARY OF THE INVENTION

The present invention overcomes these problems by providing an insert having one or more rigid members, each of which may be comprised of varying metals, woods, and ceramics, and which is inserted between the bridge saddle of the instrument and the string tie-down members, without alternating the original construction of the instrument. The varying rigid member materials are placed in contact between respective strings and the sound table of the instrument to increase sustain; change timbre; and produce reverberation in the instrument. A soft, pliable material may be used to hold the rigid members in place between sound table and string.

Additional objects and advantages will become apparent and a more thorough and comprehensive understanding may be had from the following description taken in conjunction with the accompanying drawings forming a part of this specification.

BRIEF DESCRIPTION OF THE DRAWINGS

FIG. 1 is a perspective view of a guitar showing placement of the insert of the present invention.

FIG. 2 is a perspective view of the insert.

FIG. 3 is a side view of the device, in section, showing placement within a guitar.

FIG. 4 is a side view of one embodiment of the insert of the present invention.

FIG. 5 is a side sectional view of another embodiment of the insert of the present invention, showing laminated structure.

FIG. 6 is a side view of another embodiment of the insert of the present invention showing adjacent rigid members spaced rearwardly from the bridge saddle.

DETAILED DESCRIPTION OF THE INVENTION

Referring now to the drawings, and to FIGS. 1-3, in particular, an embodiment to be preferred of a sound enhancing insert 10, made according to the present invention, is disclosed. Insert 10 is insertible between the bridge saddle 6 and string tie-down member or members 5 of a stringed instrument such as guitar 3, having a sound table 2.

Insert 10, in the preferred embodiment shown in FIGS. 1-3, includes a plurality of rigid members 11, laterally spaced from one another, and embedded in a flexible support member 20. Each of the rigid members may be constructed of metal, wood, rigid plastic, rigid leather, bone, or ceramic, or laminates of each. Preferred metals are brass, steel, and aluminum; preferred woods are elm and oak; rigid plastics include the acrylics and polycarbonates; glass, and any of the class of ceramics, may also be used. As may be seen, an extremely large number of variations may be had for each individual string for a large variety of sound effects. Each of the rigid members 11 extend through the flexible support member 20 so as to have a top surface engaging the bottom surface of a respective string 7 and a bottom surface engaging the top surface of sound table 2. The horizontal portion of the bridge is considered to be a part of the sound table. It has found that very thin strips of paper or fabric, not shown, may be placed on the bottom surface of the rigid members to prevent abrasion of the sound table, without significantly altering the sound effects generated. Flexible support member 20 may be constructed of any flexible material having sufficiently resiliency to keep the insert in place and to adjust to different bridges. Neoprene has been found to be very suitable and is the preferred material for this function, though polyethylene an other soft plastic material may likewise be used. As may be seen to advantage in FIG. 3, rigid member 11 is embedded within the support member 20 with a portion 21 of the support member being rearward, i.e., toward the tie-down members 5, and a second portion 22 being forward of the rigid member. Tie down members 5 may be individual bridge pins, as shown, or may be in the form of a common slot, each string held by a string ball or other member engaging the material forming the slot. Portion 21 of the support member engages one or more of the strings 7 and is pushed downwardly by the string or strings to force the bottom surface of the rigid member into contact with the top surface of the sound table 2 or the top surface of the horizontal portion of bridge 8, as the case may be. Portion 22 of support member 20 forces the top of rigid member 11 upwardly into contact with string 7. It is to be understood that the term "sound table" as used herein and in the appended claims includes the horizontal portion of the bridge; the horizontal portion of the bridge being considered a part of the sound table.

Referring now to FIG. 4, a most basic type of insert 10 is shown to advantage. This insert does not include the flexible support member, but rather comprises a rigid member placeable between string or strings and the sound table. The insert of this embodiment preferably has a flattened undersurface which frictionally engages the sound table for holding the insert in place between bridge saddle 6 and tie-down members 5.

FIG. 5 shows another embodiment of insert 10 of the present invention. In this embodiment, flexible support member 20 is present. Rigid member 11 is constructed of two differing materials 16 and 17, placed in contact with one another in vertically stacked orientation. Obviously, any practical number of materials comprising the rigid member may be so stacked. It is contemplated that adjacent materials will be held in place by any appropriate bonding.

FIG. 6 shows still another embodiment of the present invention with rigid inserts of varying materials, 13, 14, and 15 being placed in front to rear relationship in substantial alignment with one another within flexible support member 20, sending several different, slightly delayed, reverberating signals.

For use of insert 10, and assuming use of the insert shown in FIGS. 1 and 2 on guitar 3, shown in FIG. 1, the insert is simply slid in between saddle 6 and string tie-down members 5 on sound table 2, below strings 7. Using guitar 3 as the instrument, insert 10 rests upon the top surface of the horizontal portion of bridge 8, a portion of sound table 2. The insert is then pushed backwardly toward the tie-down members and is held in place by flexible support member 20 in its engagement with the strings and bridge, as before explained. In this position, each of the rigid members 11, constructed of selected materials of wood, metal, bone, rigid plastic, rigid leather, or ceramic, has a top surface in engagement with a respective string 7 and a bottom surface in engagement with the horizontal portion of bridge 8. With other instruments, as where only a bridge saddle is present, the rigid member or members contact the sound table underlying the strings rearwardly of the saddle.

When one of the strings 7 is picked or struck, the string vibrates; the vibration traveling into the acoustic chamber of guitar 3, causing resonation. Saddle 6, in cooperation with nut 9, determines the length of the string, setting the scale or pitch of the string. Insert 10, located behind saddle 6, in cooperation with that portion of the string between the saddle and tie-down member 5, sends a second signal to sound table 2. This second signal has tone, sustain and reverberation characteristics dependent upon the material used in construction of rigid member 11, enhancing the sound of the guitar. This second signal is slightly delayed causing reverberation having a slight echo effect, giving increased depth to the sound. It is to be noted that no reconstruction of the guitar is required and that the insert can be readily removed without structural damage to the guitar.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. In a stringed instrument having a sound table; a bridge saddle mounted on the sound table; and a plurality of strings, each provided with a tie down member, an insert mountable between the bridge saddle and the tie-down members, said insert including an elongated flexible support member for holding a rigid member in place on the sound table between string and sound table, said rigid member engaging on a bottom surface the sound table and on a top surface a respective string for causing reverberation of the sound.

2. The device as described in claim 1 wherein said rigid member comprises metal.

3. The device as described in claim 1 wherein said rigid member comprises wood.

4. The device as described in claim 1 wherein said rigid member comprises ceramic material.

5. The device as described in claim 1 wherein said rigid member comprises rigid plastic.

6. The device as described in claim 1 wherein said rigid member comprises bone.

7. The device as described in claim 1 wherein said insert includes a plurality of rigid members, each of said rigid members engaging a respective string.

8. The device as described in claim 1 wherein said support member comprises a soft plastic material.

9. The device as described in claim 8 wherein said support member is constructed of neoprene.

10. The device as described in claim 1 wherein said rigid member is constructed of a plurality of rigid materials bonded together.

11. In a stringed instrument having a sound table; a bridge saddle mounted on the sound table; a plurality of strings, each string provided with a string tie down member, an insert mountable between the bridge saddle and the tie-down members, said insert comprising an elongated flexible support member and a plurality of rigid members held in horizontal spaced alignment within said support member; said support member operable to engage the strings of said instrument and the sound table to hold each of said rigid members in contact with a respective string and the sound table for enhancing the sound of the instrument.

12. The device as described in claim 11 wherein said flexible support member comprises a resilient plastic material.

13. The device as described in claim 12 wherein said plastic material is neoprene.

14. The device as described in claim 11 wherein said rigid member is constructed of a plurality of rigid materials bonded together.

15. The device as described in claim 11 further comprising an insert provided with rigid members mounted adjacent one another in substantial alignment between the saddle and a respective tie down member.

16. The device as described in claim 11 wherein one of said rigid members comprises metal.

17. The device as described in claim 11 wherein one of said rigid members comprises wood.

18. The device as described in claim 11 wherein one of said rigid members comprises ceramic material.

19. The device as described in claim 11 wherein one of said rigid members comprises rigid plastic material.

* * * * *